US006959574B2

(12) United States Patent
Nishi

(10) Patent No.: US 6,959,574 B2
(45) Date of Patent: Nov. 1, 2005

(54) CONTINUOUS PICKLING AND COLD-ROLLING EQUIPMENT AND OPERATING METHOD THEREOF

(75) Inventor: Hidetoshi Nishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 137 days.

(21) Appl. No.: 10/101,476

(22) Filed: Mar. 20, 2002

(65) Prior Publication Data

US 2003/0056558 A1 Mar. 27, 2003

(30) Foreign Application Priority Data

Sep. 21, 2001 (JP) ..... 2001-287994

(51) Int. Cl.[7] ..... B21B 45/04
(52) U.S. Cl. ..... 72/39; 72/203; 72/365.2
(58) Field of Search ..... 72/39, 40, 199, 72/203, 365.2, 366.2, 206; 228/158; 29/81.03, 81.06, 81.07, 81.09, 81.11, 81.12, 81.13

(56) References Cited

U.S. PATENT DOCUMENTS

| | | | | | |
|---|---|---|---|---|---|
| 3,998,174 | A | * | 12/1976 | Saunders | 72/349 |
| 4,552,299 | A | * | 11/1985 | Sendzimir | 228/5.7 |
| 5,248,372 | A | * | 9/1993 | McNamee | 156/345.2 |
| 5,826,818 | A | * | 10/1998 | Douaud | 242/615.21 |
| 6,210,501 | B1 | * | 4/2001 | Okano et al. | 148/655 |
| 6,453,709 | B2 | * | 9/2002 | Leroux et al. | 72/39 |
| 6,537,398 | B1 | * | 3/2003 | Ljungars | 148/651 |

FOREIGN PATENT DOCUMENTS

| | | | |
|---|---|---|---|
| DE | 2326407 | | 12/1974 |
| JP | 64-057906 | | 6/1989 |
| JP | HEI 10-128403 | | 5/1998 |
| WO | 00/37189 | | 6/2000 |
| WO | WO 00/37190 | * | 6/2000 |

OTHER PUBLICATIONS

Yoshimoto et al., *Continuous Descaling and Tandem Cold Mills,* The Hitachi Hyoron, vol. 70, No. 6, pp. 72–80, Jun. 1988.

Hosomi et al., *Construction of Pickling and Cold–Rolling Connected Continuous Mill (2CP–4TM) at Sakai Works,* Nisshin Steel Technical Information, vol. 63, pp. 134–144, Dec. 1990.

Office Action with English Translation.

* cited by examiner

*Primary Examiner*—Lowell A. Larson
*Assistant Examiner*—John S Goetz
(74) *Attorney, Agent, or Firm*—Crowell & Moring LLP

(57) ABSTRACT

A new configuration and operating method therefore improves conventional continuous pickling and cold-rolling systems in response to increasing demands for high-propertied steel plates. The continuous pickling and cold-rolling equipment system comprises a uncoiling apparatus, a joining apparatus, an accumulating looper, a cleaning section, a pickling section, a cold rolling mill, a cutting apparatus, and a coiling apparatus. This configuration and associated operation method realize a rolling line having a substantially infinite number of mill stands enabling continuous or endless cold rolling without additional mill stands. Thereby, production of cold rolled steel strip with a large total reduction ratio for high-grade steel strips effectively using a small number of mill stands becomes practicable. At least one of the embodiments clearly shows acceptable productivity that can stand comparison with a typical conventional cold rolling system.

4 Claims, 2 Drawing Sheets

CONTINUOUS PICKLING AND COLD-ROLLING EQUIPMENT AND OPERATING METHOD THEREOF

BACKGROUND OF THE INVENTION

This application claims the priority of Japanese Application No. 2001-287994, filed in Japan on Sep. 21, 2001, the disclosure of which is expressly incorporated by reference herein.

This invention relates to continuous pickling and cold-rolling equipment and operating method thereof.

In recent years, a large number of continuous pickling and cold-rolling equipment systems, each of which has a pickling section in tandem to a cold rolling section, have been installed for improving a manufacturing process for high-grade steel plates typically represented by steel plates for automobile structure uses.

For instance, Hitachi Hyoron, page 80, Vol. 70, No. 6 (1988-6), describes an example of an entire configuration of one of such continuous processing equipment systems.

The continuous pickling and cold-rolling equipment shown in the Hitachi Hyoron is very large in scale and high in cost although the equipment offers excellent productivity and quality products yield. The number of mill stands in the cold rolling section such equipment includes is usually four to five.

High-grade steel plates, such as steel plates for automobile structure uses, are increasingly demanded to have 1) more formability and 2) higher strength than ever. A satisfactory response to this changing demand is becoming not probable as long as a continuous pickling and cold-rolling equipment in a conventional configuration is used.

This means that a cold rolling system and method should satisfy the following two requirements to simultaneously meet the above-mentioned two demands with high appreciation.

1. The rolling must give a large enough total reduction ratio. This means that the plate thickness before rolling (the thickness of the material, i.e., hot rolled steel strip) should be thicker as much as possible and the thickness of finished product thinner as much as practicable. Further, no intermediate annealing should be given in the cold rolling processes.

2. The rolling must be capable of rolling hard and strong materials.

These two requirements impose more severe conditions on cold rolling processes and cause the cold rolling equipment to be more powerful.

One of the conventional methods of effecting large-reduction cold rolling is a cold rolling method performed by increasing the number of stands on a rolling mill. For instance, there is an example in a tandem cold rolling mill that is equipped with six mill stands.

As stated before however, a tandem mill is a large-scaled and expensive facility by nature. Therefore, it would not be economical to increase expensive mill stands in such facility though responding to such new demands is inevitable. The amount of rolled products that should use hard and thick material usually occupies merely a small portion of entire rolled products, 20% or so at the most. Because of this, should the mill stands be increased to cover production of this 20-percent-products, the increased part of mill stands will not fully contribute to the production of the most of the rest of products.

Consequently, the conventional method, increasing the mill stands, would not be economical; the number of mill stands in the rolling facility should be within four to five as the conventional technique.

Another conventional method for effecting large-reduction cold rolling is such a method of reducing again, by cold re-rolling (DCR: Double Cold Reduction, sometimes referred to as DR), the material reduced once by cold rolling. For example, JP A 10-1284003 has disclosed this method. However, this technique cannot respond to the objective that the present invention deals for the reason detailed below. Because, in this technique, the material is usually cold rolled first then annealed before DCR-processing. The reason why the material is annealed before DCR-processing is the work hardening. The steel strip becomes hardened with cold rolling substantially causing too high rolling load to permit successive cold rolling in an ordinary manner. If further cold rolling is required over this work-hardened steel strip down to the desired thickness within a usual technique, annealing is necessary to reduce the hardness of the steel strip. Therefore, prior arts have necessarily applied annealing before DCR-process when obtaining a steel strip having certain thinness or thinner is desired.

However, the high-grade steel plates that will meet recent demands require a larger total draft in the cold rolling permitting no intermediate annealing in the cold rolling processes. This means that, if annealed, the retained effect, in a metallurgical sense, by cold rolling that will contribute to micronization of crystal grain would disappear. Accordingly, the effect of successive cold rolling in the DCR-process is limited to an extent that would be given by a draft usually available in a cold rolling after annealing. As a result of this, the micronization of crystal grain remains within an inadequate extent.

Therefore, the conventional DCR-process having an intermediate annealing cannot satisfactorily respond to recent demands. Thus, it is necessary to make it possible to effect cold rolling under such a severe rolling operation condition that a material is cold-rolled down to desired thicknesses without intermediate annealing in order to obtain finely micronized crystal grain.

In the conventional DCR-process, an annealed steel strip loses its elasticity and becomes easily bendable. This bendability in material caused by annealing makes handling of a steel strip very delicate and imposes difficulty on automating, tandemizing, and enlarging of equipment scale. Therefore, the conventional DCR-process is limited necessarily to a relatively small scale accompanied with special operating techniques: mostly a batch rolling method that rolls coil by coil of steel strips. This batch rolling method requires an expensive and complicated mill guide to pass a thin and easily bendable material to be rolled one by one into the rolling mills. Further, lower productivity and yield are inevitable because of batch handling.

It may be additionally mentioned that, in recent years, a continuous line has been installed which has an annealing section in tandem, or otherwise performs tempering rolling or cold re-rolling after the annealing. JP A 7-60305 is one example disclosing this style. These production lines permit a continuous operation by joining steel strips with each other at the entrance side of the line and perform tempering rolling and cold re-rolling. However, this style has been based on the condition that annealing should be given before application of tempering rolling or cold re-rolling. Therefore, this method cannot solve the objective matter that the present invention intends to achieve.

Further to the above, another method in a conventional cold re-rolling is described as follows. That is, there is a style in the DCR-process that repeats cold rolling without intermediate annealing. For example, when the number of mill stands in a production line is originally small or when cold re-rolling under different rolling specification is intended, the cold re-rolling has been applied without annealing even to common steels, and moreover applied to special steels particularly such as stainless steel or tool steel, and nonferrous metals. These examples all handle small amounts of production, and cold re-rolling therein are conducted in a batch style, even the style invites inefficiencies and low production yield. This processing style may be feasible for tandemizing. However, the tandem style is feasible only for rolling process, because a method for pickling or descaling for such special steels is different from that for common steels. Therefore, a tandem configuration of pickling with cold rolling is not feasibile, much less with inclusion of cold re-rolling. Thus, the conventional DCR-process cannot realize an economical and efficient cold re-rolling.

SUMMARY OF THE INVENTION

As stated above, it is required for the coming cold rolling for high-grade steel plates to be conducted under a more rigorous operating condition. However, in the conventional rolling facility, cold rolling has not been conducted in an efficient and economical manner. It is therefore desired to realize a cold rolling equipment where cold rolling can be effected under operating conditions becoming more severe hereafter, yet it retains advantages of a continuous cold rolling system without an increased number of expensive mill stands and expensive complicated mill guides, giving an effective substantially infinite number of mill stands.

An object of the present invention is to provide a continuous cold rolling equipment system and an operating method thereof wherein said equipment can efficiently roll with a smaller number of mill stands while retaining advantages of continuous cold rolling system.

In the present invention, a coiled steel strip once cold rolled with a continuous pickling and cold-rolling equipment is supplied to the entrance side of the pickling section and joined to be cold rolled again. Repeating this process will theoretically provide an infinite number of mill stands allowing to roll down the product to the desired thickness no matter how thick and hard the material is.

Other objects, advantages and novel features of the present invention will become apparent from the following detailed description of the invention when considered in conjunction with the accompanying drawings.

DETAILED DESCRIPTION OF THE DRAWINGS

Figure 1:
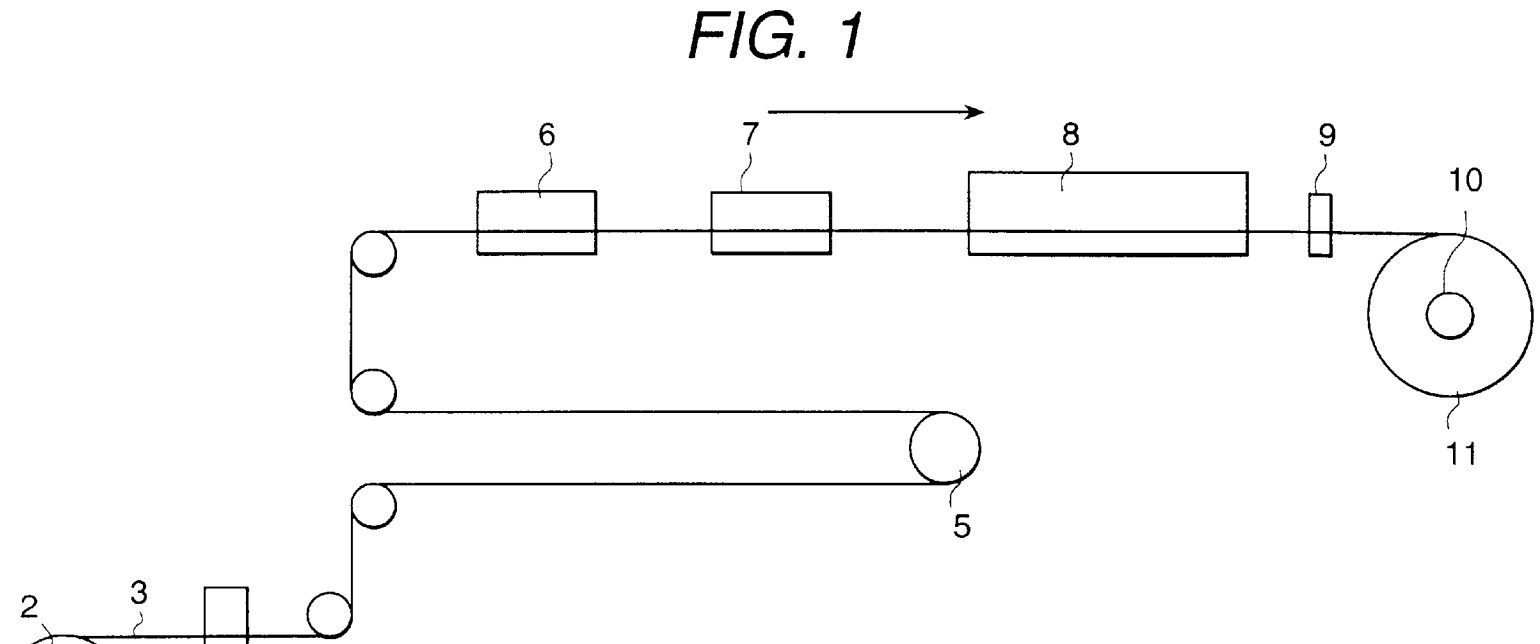
FIG. 1 shows an embodiment of a continuous pickling and cold-rolling equipment system according to the present invention.

Realization of steady and efficient operation of the above-mentioned repeated rolling requires clearing of the following matters.

1. The viewpoint of improved productivity prefers a minimized number of repeating times. Therefore, a rolling with large reduction should be realized. For this purpose, a 6-high rolling mill is preferred since such rolling mill has an excellent performance in heavy reduction rolling.

Further to this, rolling oil in this rolling should have a good lubrication performance. However, it should be noted that rolling oil of good lubrication performance generally has high viscosity, which tends to remain on the rolled strip surface.

2. The strip once rolled and coiled is supplied for re-rolling with the rolling oil left thereon, which requires a different consideration from those in the conventional DCR-process. That is, in the conventional DCR-process, the rolling oil that adhered in the first cold rolling is removed by burning out which takes place in annealing. Then the strip is supplied to re-rolling with the surface thereof oil-free. Contrary to this, the strip to be re-rolled in the embodiment of the present invention has rolling oil thereon because annealing is not conducted. Therefore, the pickling performance will be disturbed if rolling oil enters a pickling tank while re-rolling.

There is another risk: a strip walking or wandering due to slippage while travelling through an accumulating looper if the strip has rolling oil thereon. To solve this problem, the rolling oil adhered on the strip should be removed in the upstream section of the pickling tank. More preferably, the oil should be removed in the upstream of the accumulating looper.

To remove the rolling oil, it is enough, for example, to provide a cleaning section having a cleaning brush or a cleaning tank filled with electrolytic liquid like alkaline liquid, and then to pass the rolled strip through such cleaning section. By providing the cleaning section, it becomes possible to effect a stable operation in a looper and a pickling section.

The cleaning prefers less operation, if possible, for top end threading and tailing-out of the strip, therefore, the cleaning section is favorable to be installed downstream of the joining apparatus. The travelling speed of the strip is also preferred to be constant, thus, the location of the cleaning section is better to be downstream to the accumulating looper and upstream of the pickling tank.

What the cleaning intends to remove includes any of foreign matters adhering on the strip. Then in the present invention naturally, the rolling oil applied at the rolling mill located downstream to the cleaning section is also the significant objective foreign matter to be removed in the cleaning.

A rolled material once cleaned on its surface does not necessarily require being followed by pickling. When pickling is not required, the pickling tank in the pickling section may be emptied while the rolled material passes therethrough. However, it should be remembered that re-adhesion of scale onto the cleaned strip might occur as the strip passes through the emptied tank, because the pickling section usually has, around its entrance, a scatter or repletion of scale (or rust) descaled from the hot rolled strip surface. This re-adhered scale can be removed using the pickling section. Further, the flatness of the strip can be improved using a tension-leveler type mechanical descaler, an apparatus often installed at the entrance of the pickling tank.

When pickling of a hot rolled strip coil is intended before cold rolling, the cleaning section may engage in washing the strip surface, but the cleaning tank can be emptied when the strip passes therethrough instead.

3. The strip to be re-rolled requires being coiled on a proper bore diameter at the exit side to suit re-loading on the uncoiling apparatus located at an entry side of the equipment. To facilitate this, the drums of the exit coiling section and entry uncoiling section preferably have the same diameter. In addition, improved material handling prefers close location of the uncoiling apparatus to the coiling apparatus and, moreover prefers, provision of a means for the strip coil transportation between them. The closest location may be such arrangement that returns the strip to be rolled directly to the entrance side of the uncoiling apparatus from the coiling apparatus.

4. The strip coils to be re-rolled are joined series using a joining apparatus such as a welder, with two or more in number required to be provided, depending on material or thickness difference of the strip.

5. The strip coil to be re-rolled in embodiments of the present invention has not given any annealing unlike the strip in the conventional DCR-process. Therefore, the strip retains springy behavior and is less bendable offering eased automating in uncoiling and strip threading work at the entrance of the equipment as long as the apparatus arrangement is suitably designed. This means that the operating method and arrangement of manufacturing apparatuses should be designed so that processing flows continuously. This art should be realized particularly in the facility style similar to a continuous pickling and cold-rolling equipment that has been installed in number as strip steel production lines.

Embodiment 1

FIG. 1 shows an example of an embodiment of a continuous pickling and cold-rolling equipment system according to the present invention.

A material to rolled 3 uncoiled from a feed-out strip coil 1 at an uncoiling apparatus 2 is joined in series by a joining apparatus 4 to permit continuous operation. While joining, feeding-out of the material to be rolled 3 from the feed-out strip coil 1 stops, but an accumulating looper 5 is provided to assure undisturbed travel of the material to be rolled 3 to downstream thereof.

The material to be rolled 3 passes through a cleaning section 6 with emptied cleaning liquid therefrom and enters a pickling section 7 for descaling surface thereon with acidic liquid followed by washing the acidic liquid off with water, and then dried and rolled by a cold rolling mill 8.

At that time, rolling oil adheres on the surface of the material under rolling. The material to be rolled 3, after being rolled, is cut by a cutting apparatus 9 and wound in a strip coil 11 at an exit coiling apparatus 10 as an exit side coil of once-rolled material.

When the strip coil 11 once rolled is to be re-rolled, the strip coil 11 is transferred by a transportation means for the strip coil 11 from the exit coiling apparatus 10 to the uncoiling apparatus 2. Then, said coil strip 11 is fed out from the uncoiling apparatus 2 located at the entry of the equipment to be jointed sequentially by the joining apparatus 4. After that, the material to be rolled 3 travels further to the cleaning section 6 via the accumulating looper 5 for removal of the rolling oil on the surface thereof at the cleaning tank filled with cleaning liquid. In this manner, the cleaning section 6 performs a function of removing the rolling oil by filling it with the cleaning liquid when re-rolling, and is used, with the cleaning liquid being discharged to be empty when first rolling, as mentioned above. That is, the cleaning section 6 is used selectively according to the case where the cleaning function is performed or the case where not performed, according to rolling times.

In this embodiment, the cleaning section is located downstream of the accumulating looper 5. This is because this configuration permits the strip speed downstream of the accumulator section to be made uniform without particular difficulty and the cleaning speed becomes easy to be maintained at an undisturbed rate, although the travelling speed of the strip on the upstream side of the accumulating looper 5 rises and falls while joining at the joining apparatus 4 is ongoing.

The material to be rolled 3 coming out of the cleaning section 6 goes into the pickling section 7 again. However, the pickling tank may be filled with the acidic liquid in this stage, because the rolling oil does not mingle together the acidic liquid in the pickling tank. Alternatively, the acidic liquid may be emptied out of the pickling tank instead, because no scale exists on the surface of the rolled material. The pickling section 7 can be used under the condition that it is filled with the acidic liquid or under the condition that it is empty, according to necessity.

After that, the material to be rolled 3 is re-rolled by the cold rolling mill 8 and is coiled at the coiling apparatus 10 as the strip coil 11 of the exit side. Where re-re-rolling is intended, the strip coil 11 is transferred again to the entry side.

Rolling can be repeated in this manner as many times as required.

Embodiment 2

Figure 2:
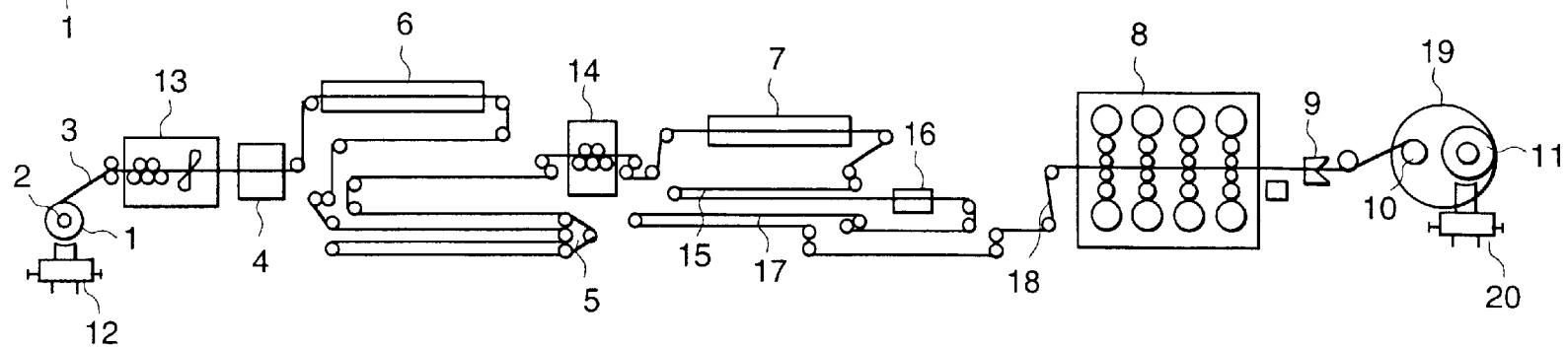
FIG. 2 shows an embodiment of a continuous pickling and cold-rolling equipment system according to the present invention.

FIG. 2 shows another embodiment of the present invention. In this embodiment, the cleaning section 6 is located downstream of the joining apparatus 4 but upstream of the accumulating looper 5. This configuration removes the rolling oil adhered on the surface of the material to be rolled 3, which has been once rolled before this stage, before the material enters the accumulating looper 5. Therefore, a slippage or meandering of the material on the accumulating looper 5 is prevented. The cold rolling mill 8 in this embodiment is comprised of four stands of a 6-high rolling mill because of its large reduction capability, wherein a rolling oil such as tallow-based rolling oil is used as it has an excellent lubrication performance.

The embodiment shown in FIG. 2 is detailed as follows. A hot rolled strip coil is unloaded from an entry coiler car 12 onto the uncoiling apparatus 2 as the feed-out strip coil 1, then, the coil is uncoiled and fed out as the material to be rolled 3. After being treated at an end preparation apparatus 13, the material to be rolled 3 is joined in series at the joining apparatus 4 and then enters the accumulating looper 5 through the cleaning section 6 of which cleaning tank is empty.

The material to be rolled 3 is further processed at a scale breaker 14 of a leveler type for breaking scale thereon and travels into the pickling section 7 for complete removal of the scale. The material thus descaled is adjusted for its width by a side trimmer 16 arranged between an intermediate accumulating looper 15 and a delivery side accumulating looper 17. Then the trimmed material is fed, via a path centering apparatus 18, to the cold rolling mill 8 of a tandem style for rolling. The rolled material is then cut by the cutting apparatus 9 to be coiled on a drum as the strip coil 11 of exit side by the exit coiling apparatus 10 mounted on a carousel reel 19, then conveyed out by an exit side coiler car 20 in a series of strip coils.

When cold re-rolling is intended, the strip coil 11 of the exit side is unloaded from the entry side coiler car 12 to be loaded again on the uncoiling apparatus 2 for feeding out as the material to be rolled 3. And then, after being prepared at the end treatment apparatus 13, the material to be rolled 3 is joined at the joining apparatus 4 in series; the rolling oil adhering thereon is removed at the cleaning section 6, wherein the cleaning tank is filled with cleaning liquid in this processing stage; and enters the accumulating looper 5. At the stage of re-rolling, no treatments by the scale breaker 14 and the side trimmer 16 are required, and the acidic liquid tank of the pickling section 7 can be empty.

After that, the material to be rolled 3 enters, via the path centering apparatus 18, the cold rolling mill 8 arranged in a tandem style for re-rolling thereby. And then, the re-rolled material is cut by the cutting apparatus 9 to be coiled on a drum on the exit coiling apparatus 10 mounted on the carousel reel 19 as the strip coil 11 of exit side of the cold re-rolled strip. Then the coiled strip is conveyed out by the exit side coil car 20.

Embodiment 3

Figure 3:
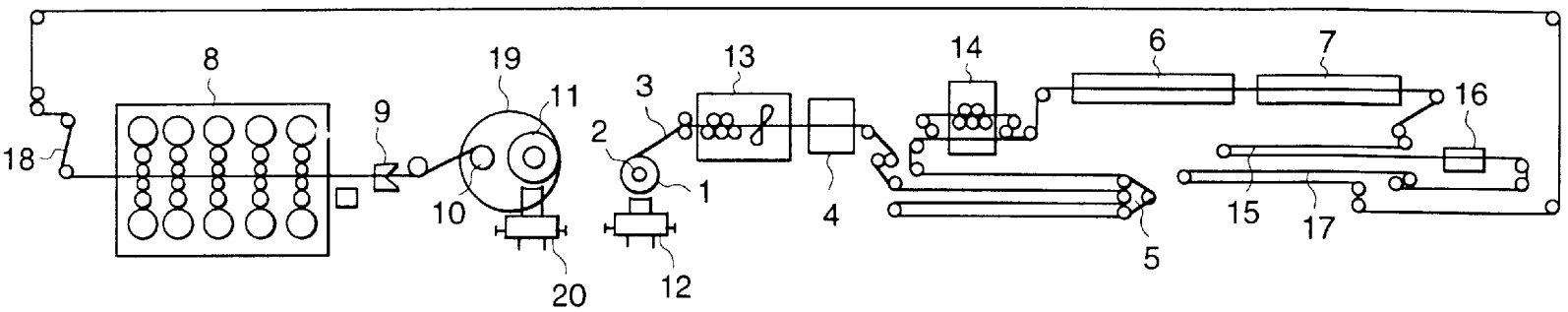
FIG. 3 shows an embodiment of a continuous pickling and cold-rolling equipment system according to the present invention.

FIG. 3 shows further another embodiment of the present invention. In this embodiment, the uncoiling apparatus 2 and the carousel reel 19 are arranged close to each other. This arrangement makes the distance for transferring the strip coil to be re-rolled between the exit side and entry side shorter causing simplification of material handling.

Additionally to the above feature, the cold rolling mill 8 is composed of five stands of the 6-high rolling mill to give a larger reduction.

Embodiment 4

Figure 4:
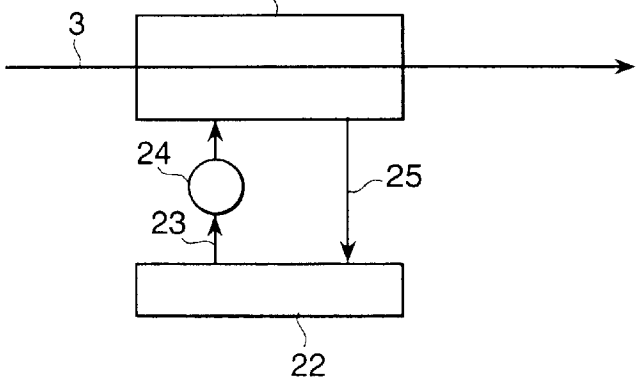
FIG. 4 shows a device arrangement around the line tank in the continuous pickling and cold-rolling equipment system according to an embodiment of the present invention.

FIG. 4 shows an embodiment for the peripheral apparatus arrangement in the cleaning section 6 or the pickling section 7, wherein an example of apparatus for quick charging or draining of the cleaning liquid or acidic liquid is shown.

To a line tank 21 for cleaning or pickling through which the material to be rolled 3 passes, a liquid is charged by a charging pump 24 from a storage tank 22 through a feeding circuit 23. From the line tank 21 on the other hand, the liquid is discharged, by gravity for example, to the storage tank 22 through a draining circuit 25. In discharging, a pump may be used in the middle of the discharging circuit 25.

By this peripheral apparatus arrangement, the cleaning or pickling liquid can be charged or discharged to or from the line tank within a shorter time whenever so required, causing the operation to be efficient.

Embodiment 5

Figure 5:
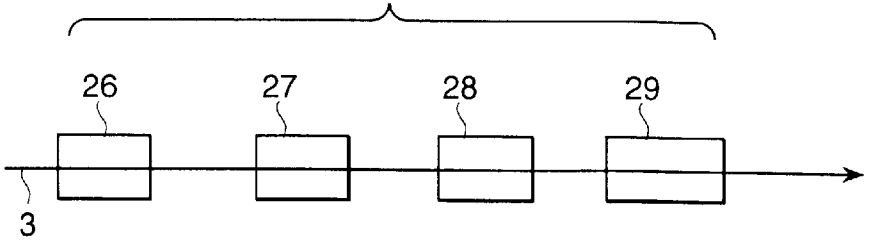
FIG. 5 shows a device arrangement in the cleaning section in the continuous pickling and cold-rolling equipment system according to an embodiment of the present invention.

FIG. 5 shows an embodiment for the internal apparatus arrangement in the cleaning section 6. Roll coolant usually used in cold rolling is composed mostly of water, but includes several percent of oil and other foreign materials such as small iron particles or matters. These foreign materials adhere on the rolled material through the rolling process.

The cleaning section removes at least such oil-component. However, cleaning is preferred further to be capable of removing other adhered materials also so that a rolled material may be fed cleaned to the downstream side of the equipment.

As the method of cleaning, chemical method like using alkaline liquid, brushing, or combination of them may be applicable.

The embodiment shown in FIG. 5 is composed of, in the order from the upstream end of the cleaning section through which the material to be rolled 3 passes to the downstream end, a rough cleaning tank 26 that uses alkaline liquid and a brush, a finish cleaning tank 27 for electrolytic cleaning, a warm water tank 28 for washing off the alkaline liquid left on the rolled material, and then a dryer 29 for drying the surface of the rolled material.

By this arrangement, the rolled material is fed to the downstream end with cleaned surfaces, i.e., at least without residual roll coolant thereon.

In addition, although the number of the joining apparatus 4 installed at the entry side in the embodiment of the present invention is desired to be one, two or more joining apparatus may be installed if required. This is because the varieties of properties and thickness of the material to be rolled sometime require use of proper types of joining apparatus.

In handling ordinary relatively thick mild steel plate for example, one set of well-known flash butt welding apparatus would be enough for operation. However, a seam welder may be required even for ordinary steel where thin rolled strip is to be handled, and a laser beam welder may be required for strips of stainless steel, high-speed steel, or of silicon steel.

In addition to the application of these embodiments of the present invention to the repeated rolling using the same equipment, it is obvious that these embodiments are also applicable to the manufacturing equipment into which the strip with roll coolant left thereon is supplied for continued cold rolling successive to the cold rolling by other equipment.

Furthermore, the present invention may be embodied in a style such that the cleaning section is added to an existing continuous pickling and cold-rolling equipment.

A comparison of the rolling schedules in the embodiment of the present invention and in a contrast example are listed in Table 1.

TABLE 1

| | Contrast Example | | Embodiment | | | |
|---|---|---|---|---|---|---|
| | 1-pass Cold Rolling | | First Cold Rolling | | Second Cold Rolling | |
| Mill stand No. | Roll-out Thickness (mm) | Draft (%) | Roll-out Thickness (mm) | Draft (%) | Roll-out Thickness (mm) | Draft (%) |
| 1 | 3.64 | 27.2 | 3.96 | 20.8 | 1.583 | 20.9 |
| 2 | 2.721 | 25.3 | 3.244 | 18.1 | 1.174 | 25.8 |
| 3 | 2.021 | 25.7 | 2.701 | 16.7 | 0.839 | 28.5 |
| 4 | 1.433 | 29.1 | 2.287 | 15.3 | 0.620 | 26.1 |
| 5 | 1.002 | 30.1 | 2.000 | 12.5 | 0.500 | 19.4 |
| 6 | 0.672 | 33.0 | — | — | — | — |
| 7 | 0.500 | 25.6 | — | — | — | — |
| Exit Speed (mpm) | 1000 | | 600 | | 1250 | |

The material to be rolled is medium carbon steel, slightly harder than soft mild steel, and the dimensions of material are 5.0 mm thick and 1000 mm wide. The total draft is set at 90% to assure acceptable quality, and finished thickness is 0.5 mm. The rolling mill has a work roll of 500 mm diameter; and driving power is 4000 kW for each mill stand. A tallow-based oil emulsion is used as the roll coolant.

The contrast example needs as many as 7 mill stands in total for the cold rolling with 90% of total draft to reduce the material of 5.0 mm thick down to the final thickness of 0.5 mm. This is because of the consideration for permissible operational conditions for each mill stand: such as rolling load, rolling power, rolling torque, slippage limit, and other various conditions. In this contrast example, rolling is effected in turn to plate thickness of 3.64 mm, 2.721 mm, 2.021 mm, 1.433 mm, 1.002 mm, 0.672 mm and 0.500 mm at the mill stands No. 1 to No.7, respectively. The exit rolling speed is 1000 m per minute (mpm) at No.7 mill stand.

According to the present embodiment in contrast to this, as shown in Table 1, cold-rolling is effected twice by the equipment of the present embodiment. The material of 5.0 mm thick is first pickled and cold-rolled down to 2.0 mm thick using 5 mill stands only. That is, the rolling is done in turn to thickness of 3.96 mm, 3.244 mm, 2.701 mm, 2.287 mm and 2.000 mm in the mill stands No.1 to No. 5, respectively. After this first cold-rolling, re-rolling, that is, second cold rolling is done to the thickness of 0.5 mm from the thickness of 2.0 mm. Namely, the material is rolled down in turn to thickness 1.583 mm, 1.174 mm, 0.839 mm, 0.620 mm and 0.500 mm at the mill stands No.1 to No. 5, respectively. Here, the exit rolling speed at No. 5 mill stand in the first rolling is 600 mpm, and 1250 mpm in the second rolling. Further, as mentioned above, in the present embodiment, also, the second cold-rolling is effected after the material is cleaned in the cleaning section 6 filled with cleaning liquid and rolling oil is removed from the surface of material. Therefore, an operation can be conducted well better without damaging the looper function and pickling function also when the second cold-rolling is effected.

Under the condition that the rolling process is to be continuous, a comparison of productivity of these two styles reveals features as follows. When the numerical value 1 is given to the final length of a rolled material as normalized reference, the length of the material rolled in the first rolling becomes 0.25 (=0.5/2) of the finally rolled-out length. Therefore, the ratio of rolling working time of the embodiment to that of the contrast example is:

Present Embodiment/Contrast Example $$=(0.25/600+1/1250)/(1/1000)$$

$$=1.21$$

This means that the present embodiment requires an extra working time by 21% for this product. However, if this product occupies, for example, 20% of the entire products range of a manufacturing facility, the working time increment to the whole working time of the facility would be $0.21\times0.2=0.042$. Namely, the total increase of the working time is merely about 4%, which means productivity reduction is not very much.

On the other hand, the facility cost can be largely saved as the number of mill stands, that are expensive, is reduced from 7 stands down to 5 stands.

As mentioned above, the embodiment of the present invention realizes a continuous pickling and cold-rolling equipment that accepts more severe reduction requirements than usual and has substantially an effective infinite number of mill stands, yet maintaining advantages of the continuous pickling and cold-rolling system in ordinary configurations without an increased number of the mill stands.

According to the present invention, an effect that materializes a continuous pickling and cold-rolling equipment system and its operational method which is capable of efficiently cold rolling with a reduced number of mill stands, taking advantage of continuous pickling and cold-rolling system in an ordinary configuration.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A continuous pickling and cold-rolling equipment system for rolling steel strips in plural passes, comprising:

an uncoiling apparatus for uncoiling the newly fed and already cold-rolled steel strip;

a welding station for joining the end sides of two steel strips;

a looper as a strip length compensation;

a cleaning station for washing off rolling oil from the steel strip;

at least one cold-rolling mill group comprising a plurality of mill stands, for reducing the thickness of the steel strip;

a pickling station for the descaling of the steel strip by an acid located before a first of the at least one cold-rolling mills;

a cutting apparatus for cutting the rolled steel strip; and a coiling apparatus for the rolled steel strip, wherein the cleaning station is arranged between the welding station and the pickling station, and is deactivated during a first pass of the strip and activated during one or more further passes of the strip.

2. The continuous pickling and cold-rolling equipment system according to claim 1, wherein the cleaning station is arranged in a direction of pass behind the looper which is connected subsequently to the welding station.

3. The continuous pickling and cold-rolling equipment system according to claim 1, wherein the cleaning station is arranged between the welding station and the looper.

4. The continuous pickling and cold-rolling equipment system according to claim 2, wherein a scale breaker is located between the looper and the cleaning station.

* * * * *